US009964264B2

(12) United States Patent
Mertel et al.

(10) Patent No.: US 9,964,264 B2
(45) Date of Patent: May 8, 2018

(54) FLASHLIGHT

(71) Applicant: TTI (MACAO COMMERCIAL OFFSHORE) LIMITED, Macau (MO)

(72) Inventors: Brian Mertel, Simpsonville, SC (US); Daniel Nelson, Anderson, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 92 days.

(21) Appl. No.: 15/158,228

(22) Filed: May 18, 2016

(65) Prior Publication Data

US 2016/0341373 A1 Nov. 24, 2016

Related U.S. Application Data

(60) Provisional application No. 62/163,115, filed on May 18, 2015.

(51) Int. Cl.

| | |
|---|---|
| ***F21L 4/04*** | (2006.01) |
| ***F21L 4/00*** | (2006.01) |
| ***F21L 4/02*** | (2006.01) |
| ***F21V 14/00*** | (2018.01) |
| ***F21V 17/10*** | (2006.01) |
| ***F21V 23/06*** | (2006.01) |
| *F21Y 101/00* | (2016.01) |
| *F21Y 113/00* | (2016.01) |
| *F21Y 103/33* | (2016.01) |

(52) U.S. Cl.

CPC ..... *F21L 4/005* (2013.01); *F21L 4/025* (2013.01); *F21L 4/045* (2013.01); *F21V 14/00* (2013.01); *F21V 17/107* (2013.01); *F21V 23/06* (2013.01); *F21Y 2101/00* (2013.01); *F21Y 2103/33* (2016.08); *F21Y 2113/00* (2013.01)

(58) Field of Classification Search

CPC ..... F21L 4/005; F21L 4/04; F21L 4/06; F21L 4/025; F21L 4/027; F21L 4/045; F21V 14/00; F21V 17/107; F21V 23/06; F21Y 2101/00

See application file for complete search history.

(56) References Cited

U.S. PATENT DOCUMENTS

| | | | |
|---|---|---|---|
| 4,533,982 | A | 8/1985 | Kozar |
| 5,278,739 | A | 1/1994 | Gammache |
| 5,541,822 | A | 7/1996 | Bamber |
| 5,570,948 | A | 11/1996 | Menke et al. |

(Continued)

FOREIGN PATENT DOCUMENTS

| | | |
|---|---|---|
| CN | 203797370 | 8/2014 |

OTHER PUBLICATIONS

European Search Report for Application No. 16170231.1 dated Jun. 24, 2016 (8 pages).

*Primary Examiner* — Ali Alavi
(74) *Attorney, Agent, or Firm* — Michael Best & Friedrich LLP

(57) ABSTRACT

A flashlight is operable by a power source. The flashlight includes a body having a first end and a second end. The body is configured to support the power source. The flashlight also includes a first light source positioned adjacent the first end. The first light source is electrically coupled to the power source and fixed relative to the body. The flashlight further includes a second light source coupled to the body. The second light source is movable relative to the first light source about a hinge defining a pivot axis.

19 Claims, 6 Drawing Sheets

(56) References Cited

U.S. PATENT DOCUMENTS

| | | | | |
|---|---|---|---|---|
| 5,971,562 | A * | 10/1999 | Yang | F21L 4/045 362/184 |
| 5,993,022 | A | 11/1999 | Neyer et al. | |
| 6,193,386 | B1 | 2/2001 | Reynolds | |
| 6,315,340 | B1 | 11/2001 | Chen | |
| 6,357,893 | B1 * | 3/2002 | Belliveau | F21L 4/027 257/E25.028 |
| 6,457,841 | B1 | 10/2002 | Lynch et al. | |
| 6,913,370 | B2 | 7/2005 | Ping | |
| 6,913,371 | B2 | 7/2005 | Ping | |
| 7,172,310 | B2 | 2/2007 | Hsu | |
| 7,172,312 | B2 | 2/2007 | Chen | |
| 7,178,938 | B2 | 2/2007 | Sordjan, Jr. | |
| 7,407,311 | B2 | 8/2008 | Yang | |
| 8,162,363 | B2 | 4/2012 | Wang | |
| 8,628,211 | B2 | 1/2014 | Jensen et al. | |
| 8,641,226 | B2 | 2/2014 | Yeh | |
| 8,690,376 | B2 | 4/2014 | Coleman et al. | |
| 8,746,918 | B1 | 6/2014 | Rubino | |
| 8,777,446 | B2 | 7/2014 | Sharrah et al. | |
| 2004/0052073 | A1 | 3/2004 | Chang et al. | |
| 2008/0014547 | A1 | 1/2008 | Carabillo | |
| 2011/0012382 | A1 | 1/2011 | Wang | |
| 2011/0182062 | A1 | 7/2011 | Wilson | |
| 2012/0140467 | A1 * | 6/2012 | Chang | F21L 2/00 362/235 |
| 2013/0077291 | A1 | 3/2013 | Coleman et al. | |
| 2013/0100653 | A1 * | 4/2013 | Renk, Jr. | F21L 4/022 362/184 |
| 2014/0293590 | A1 | 10/2014 | Pathy | |
| 2014/0334155 | A1 * | 11/2014 | Christ | F21L 4/08 362/249.03 |
| 2017/0336056 | A1 * | 11/2017 | Fan | F21V 19/02 |

* cited by examiner

FLASHLIGHT

CROSS-REFERENCE TO RELATED APPLICATIONS

The present application claims priority to U.S. Provisional Patent No. 62/163,115, filed on May 18, 2015.

BACKGROUND

The present disclosure relates to hand-held flashlights.

SUMMARY

In one aspect, a flashlight is configured to be operable by a power source. The flashlight includes a body having a first end and a second end. The body defines a central axis extending between the first end and the second end. The body is configured to support the power source. The flashlight also includes a first light source positioned adjacent the first end. The first light source is electrically coupled to the power source and configured to produce light in a first illumination direction. The first illumination direction is fixed relative to the central axis of the body. The flashlight further includes a light ring coupled to the first end of the body and movable with respect to the body about a pivot axis. The light ring includes a second light source electrically coupled to the power source and configured to produce light in a second illumination direction. The second illumination direction moves relative to the first illumination direction in response to movement of the light ring relative to the body about the pivot axis.

In another aspect, a flashlight is operable by a power source. The flashlight includes a body having a first end and a second end. The body is configured to support the power source. The flashlight also includes a first light source positioned adjacent the first end. The first light source is electrically coupled to the power source and fixed relative to the body. The flashlight further includes a second light source coupled to the body. The second light source is movable relative to the first light source about a hinge defining a pivot axis.

DETAILED DESCRIPTION

Figure 1:
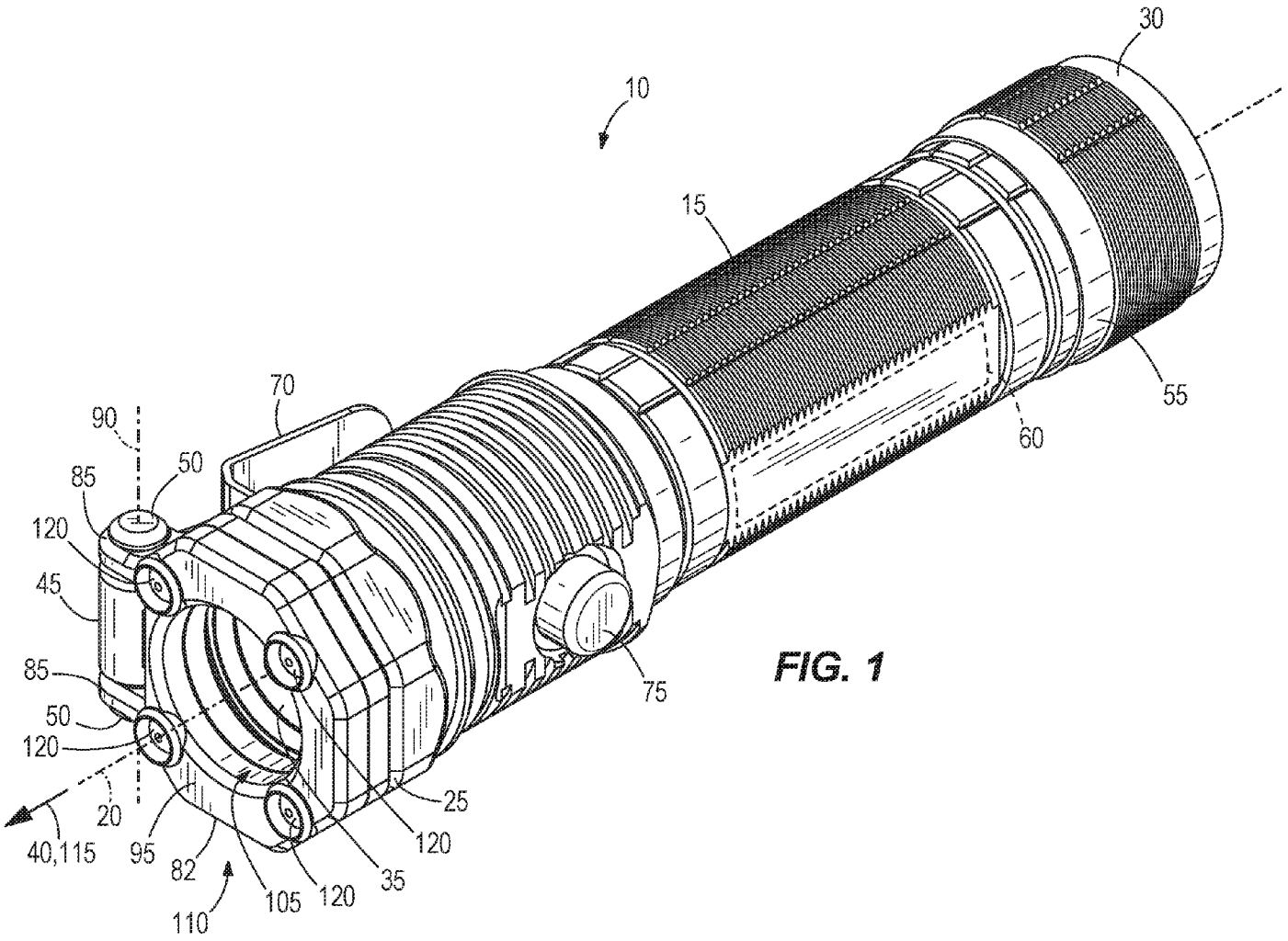
FIG. 1 is a right side perspective view of a flashlight including a light ring member according to an embodiment of the disclosure.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

FIGS. 1-9 illustrate a hand-held flashlight 10 including a body 15 defining a substantially cylindrical member having a central axis 20 with a first end 25 and a second end 30. A first light source 35 is located at the first end 25 and operable to produce light in a first illuminating direction 40 that is substantially parallel to the central axis 20 of the body 15. In the illustrated embodiment, the first light source 35 is a single three watt light-emitting-diode (i.e., LED) producing about 100 lumens of light output. In other embodiments, the first light source 35 may be multiple LEDs and/or may include a different wattage (e.g., 2 watt, 4 watt, etc.). Also, the first light source 35 may include other non-LED based light emitting elements. In the illustrated embodiment, the body 15 is manufactured from aluminum; however, in other embodiments, the body 15 may be manufactured from plastic or other suitable materials. In addition, a hinge post 45 that includes protrusions 50 is coupled to the body 15 and extends beyond the first end 25 such that the first end 25 is positioned between the hinge post 45 and the second end 30 of the flashlight 10.

Figure 2:
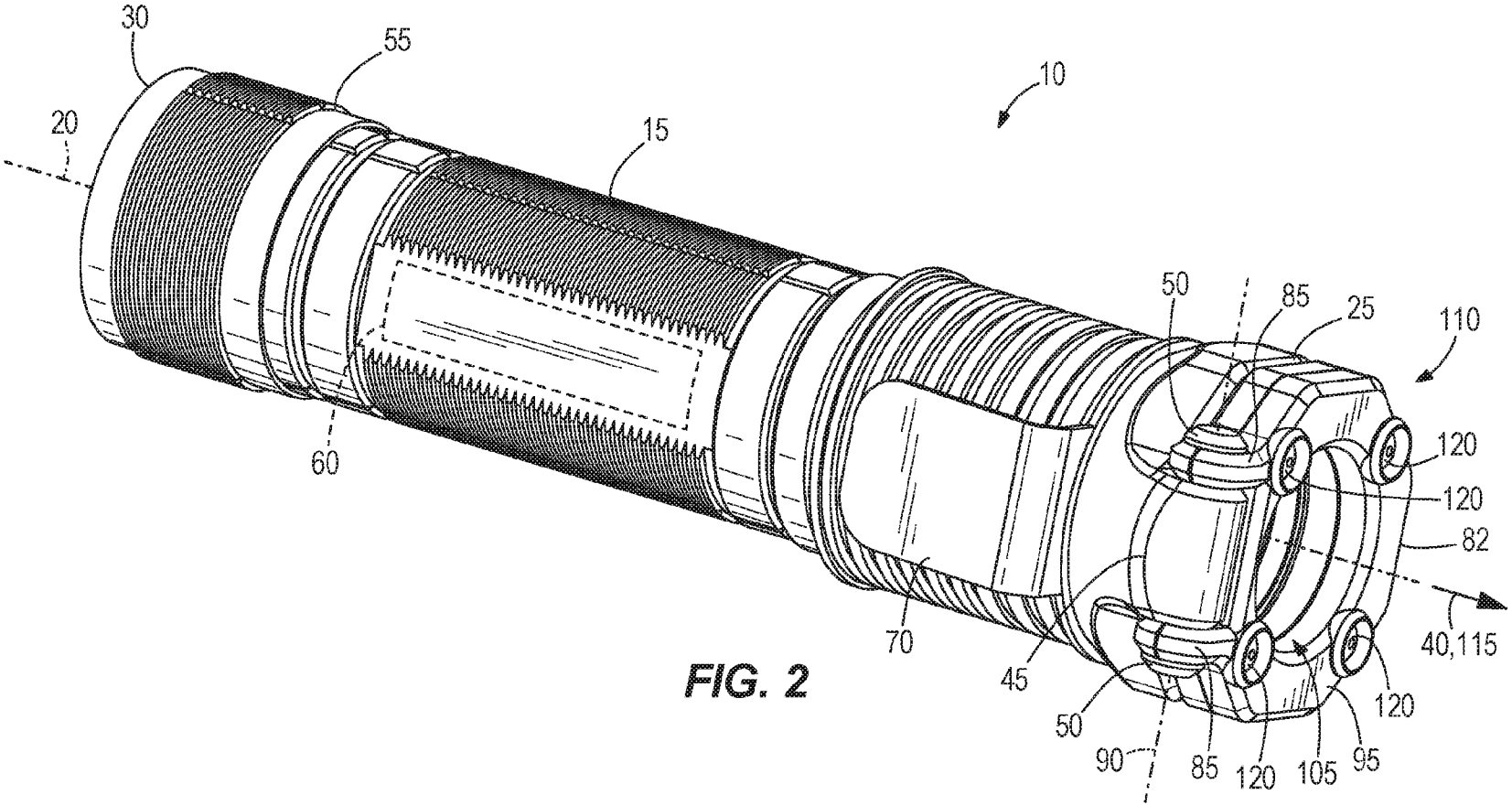
FIG. 2 is a left side perspective view of the flashlight of FIG. 1.
Figure 3:
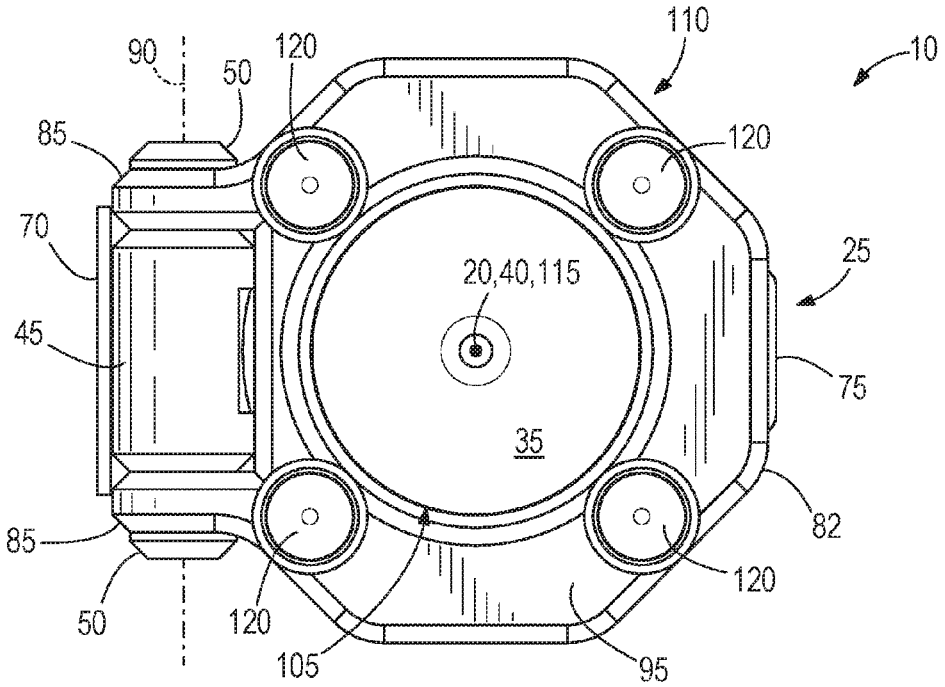
FIG. 3 is a front view of the flashlight of FIG. 1 with the light ring member in a first position.

With reference to FIGS. 1 and 2, the second end 30 of the body 15 includes a cap 55 configured to allow access to an interior portion of the body 15. The interior portion receives a power source 60 operable to power the first light source 35. In the illustrated embodiment, the power source 60 is a plurality of alkaline batteries. For example, the alkaline batteries may be two AA (e.g., double A) batteries. In other embodiments, the power source 60 may be a different chemistry (e.g., lithium) or a different standard sized battery (e.g., D batteries, C batteries, 9-volt, etc.).

As shown in FIGS. 1, 2, and 5-8, the flashlight 10 also includes a resilient clip or attachment member 70 and an actuator (e.g., a button) 75 positioned between the first and second ends 25, 30 of the body 15. The illustrated actuator 75 is operable to transition the flashlight 10 into different modes of operation, as described in more detail below. The illustrated resilient clip 70 is attached to the body 15 adjacent the first end 25 and is configured to provide hands-free operation of the flashlight 10. In particular, the resilient clip 70 is configured to be coupled to a work piece 80 (e.g., conduit as illustrated in FIG. 9). The resilient clip 70 may also attach to an operator (via a tool belt or the like) for hands-free transportation of the flashlight 10. In one embodiment, the resilient clip 70 may be removably coupled to the flashlight 10.

With reference to FIGS. 1-4, a light ring member 82 includes arms (e.g., rings) 85 that are pivotally coupled to the protrusions 50 of the hinge post 45 to allow pivotal movement about a pivot axis 90. In other embodiments, the light ring member 82 may be coupled to the second end 30 of the body 15. The illustrated pivot axis 90 is generally normal to the central axis 20 of the body 15 such that the light ring member 82 is able to flip relative to the body 15. In other embodiments, the pivot axis 90 may be generally parallel to the central axis 20 of the body 15 such that the light ring member 82 is able to rotatably slide relative to the body 15. The illustrated light ring member 82 also includes a front surface 95, a rear surface 100, a central opening 105, and a second light source 110 positioned on the front surface 95 and surrounds the central opening 105. The second light source 110 is operable to produce light in a second illuminating direction 115 that is moveable about the pivot axis 90. In the illustrated embodiment, the second light source 110 includes four discrete LEDs 120 each producing about 10 lumens of light output. In other embodiments, the second light source 110 may include more or less than four LEDs 120 and/or each of the LEDs 120 may produce more or less than 10 lumens of light output. In addition, other non-LED based sources of light could be employed. In further embodiments, the second light source 110 may be a continuous ring surrounding the central opening 105.

In addition, the connection between the arms 85 and the protrusions 50 provides electrical communication between the power source 60 and the second light source 110. For example, electrical wire(s) that are coupled to the second light source 110 may extend through the arms 85 and the protrusions 50 to couple with the power source 60. In other embodiments, the arms 85 may include electrical contacts that slidably engage with electrical contacts of the protrusions 50 to provide electrical communication between the power source 60 and the second light source 110. In further embodiments, a second power source that is distinct from the first power source 60 may be configured to operate the second light source 110.

Figure 4:
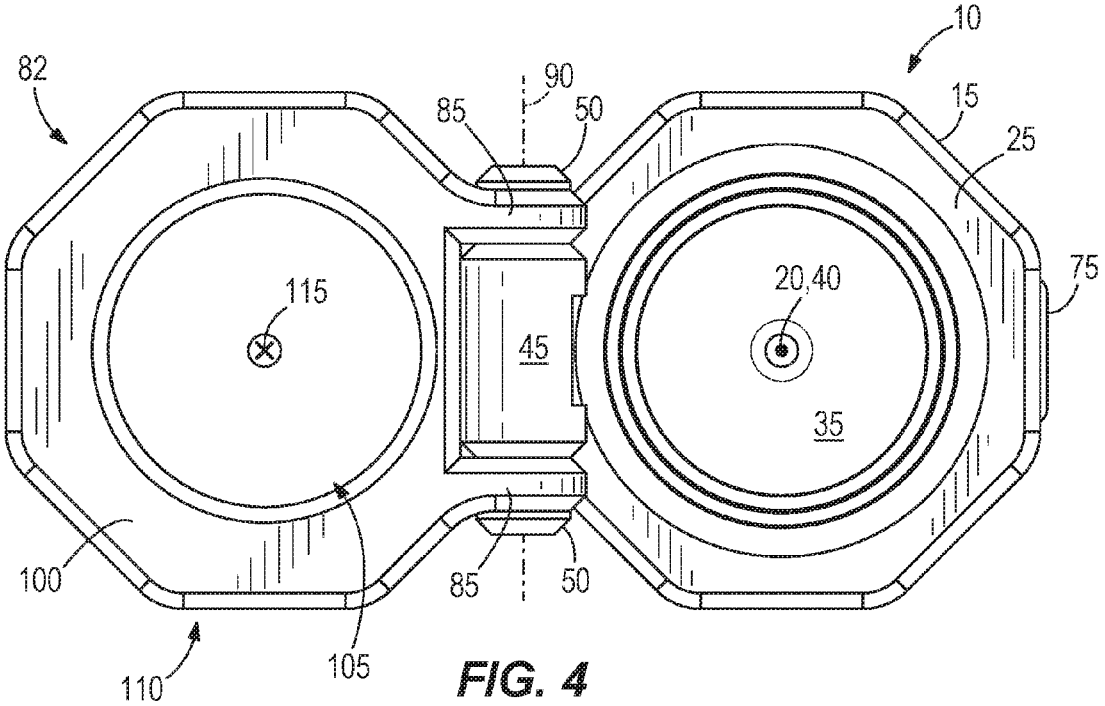
FIG. 4 is a front view of the flashlight of FIG. 1 with the light ring member in a second position.

The illustrated light ring member 82 is configured to move about the pivot axis 90 in any number of positions between a first or closed position (FIG. 3) and a second or open position (FIG. 4). In the first position of the light ring member 82, the rear surface 100 substantially abuts the first end 25 of the body 15 and the central opening 105 aligns with the first light source 35. As such, the first illuminating direction 40 travels through and is surrounded by the central opening 105, and the first illuminating direction 40 is generally parallel with the second illuminating direction 115. Stated another way, the rear surface 100 of the light ring member 82 is oriented about zero degrees relative to the first end 25 of the body 15. Accordingly, the flashlight 10 is operable as a traditional flashlight. In the second position of the light ring member 82, the light ring member 82 is moved about 180 degrees relative to the first position of the light ring member 82 such that the first and second illuminating directions 40, 115 are substantially parallel and opposite to each other.

Figure 5:
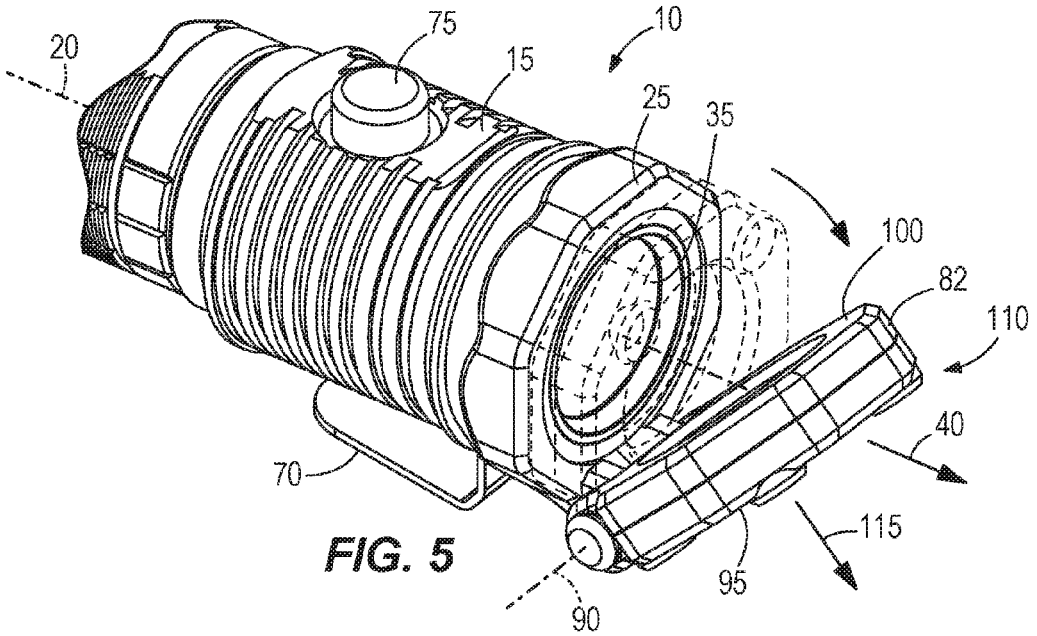
FIGS. 5-8 illustrate the flashlight of FIG. 1 including the light ring member in different positions relative to a body of the flashlight.
Figure 6:
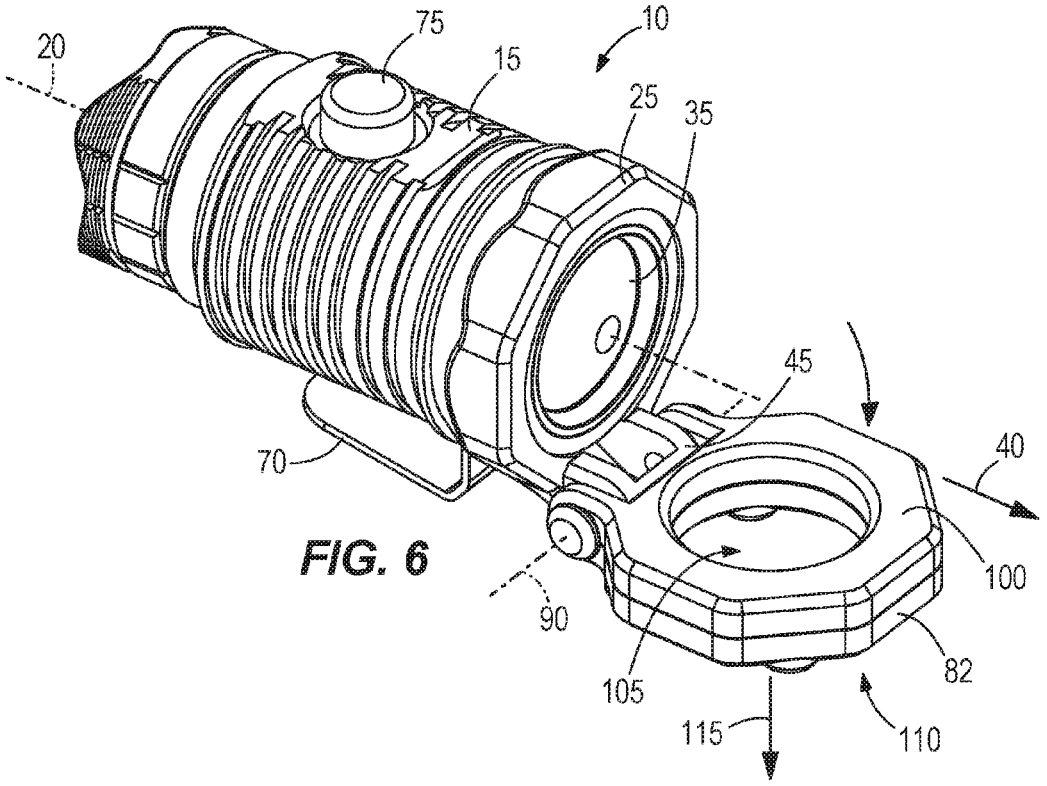
Figure 7:
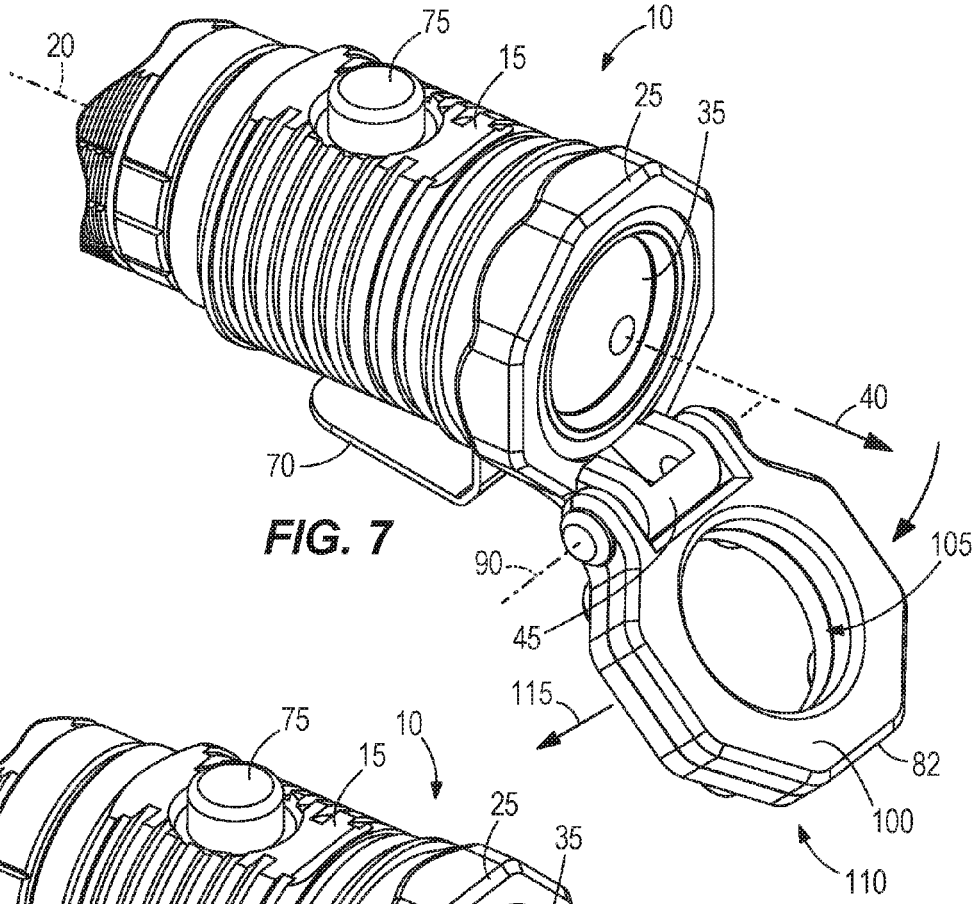
Figure 8:
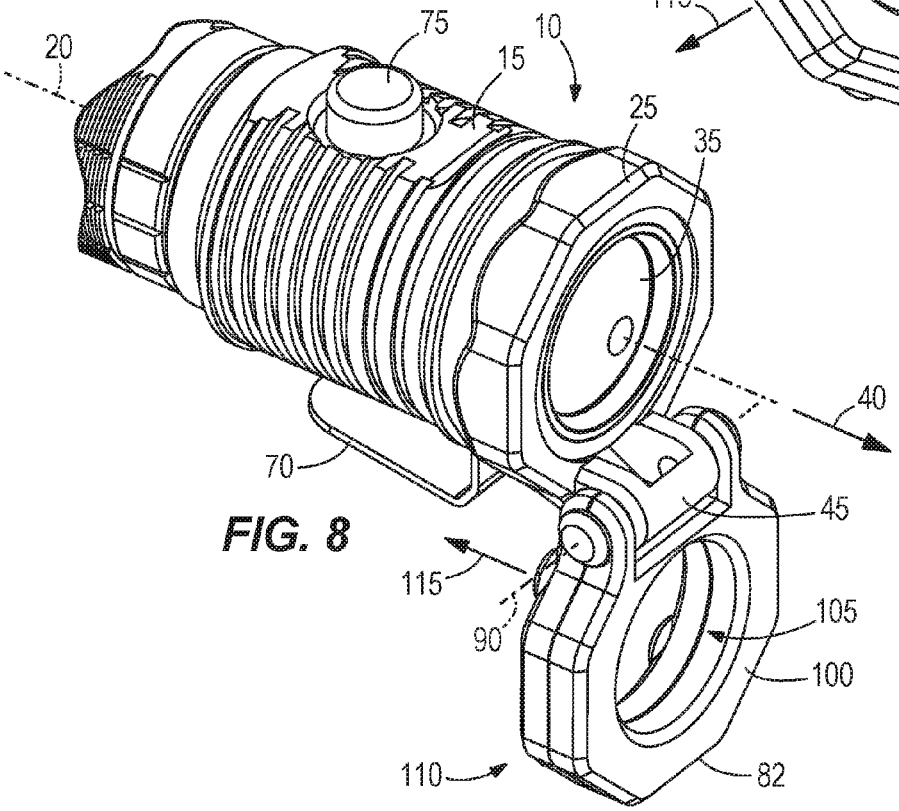
Figure 9:
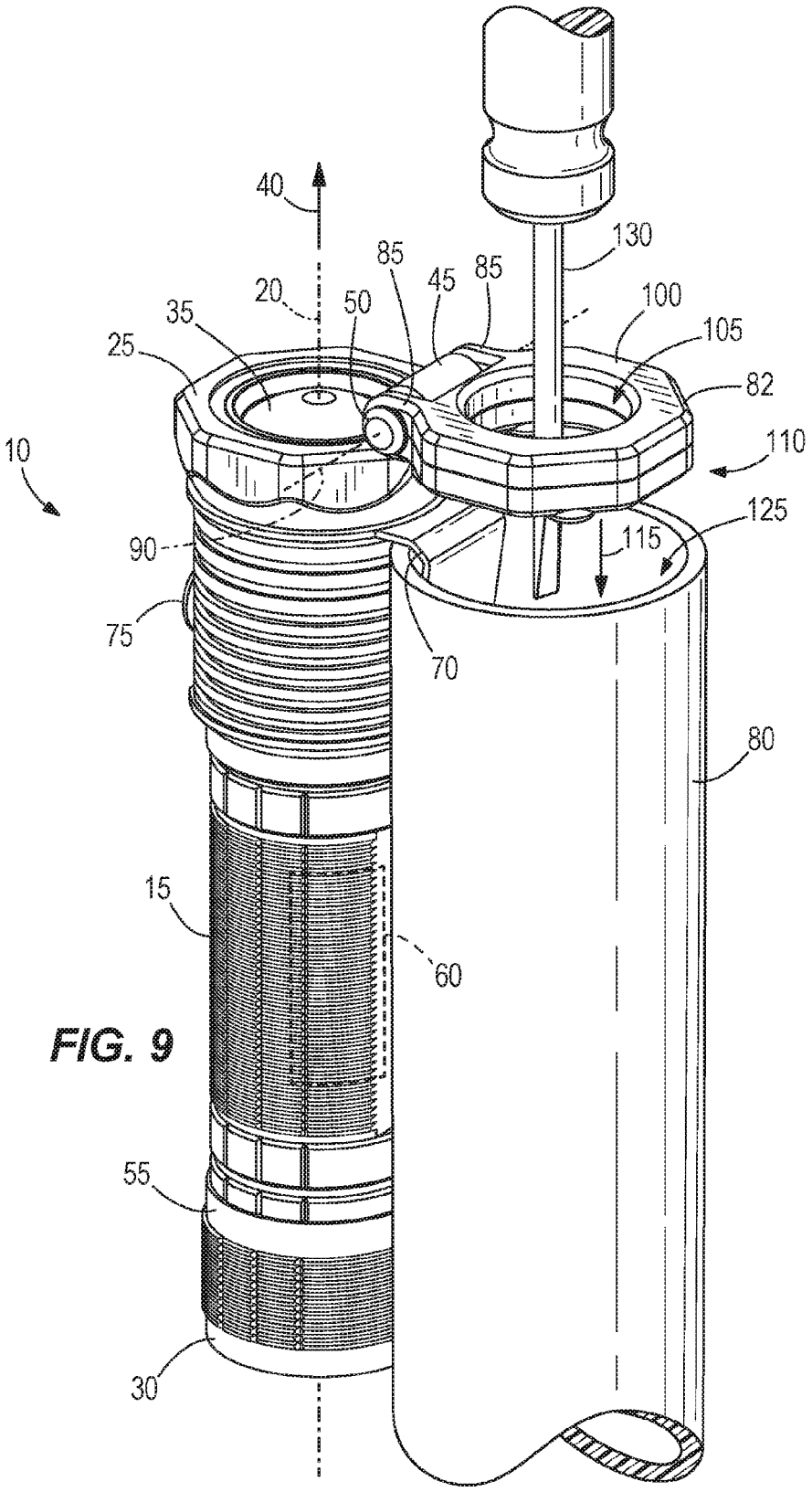
FIG. 9 illustrates the flashlight of FIG. 1 coupled to a conduit with a tool inserted within the conduit through the light ring member.

With reference to FIGS. 5-8, to selectively move the light ring member 82 from the first position (FIGS. 3 and 5) to the second position (FIGS. 4 and 8), the light ring member 82 moves through a plurality of intermediate positions. For example, the light ring member 82 is moveable to a first intermediate position defining a first angle (e.g., 45 degrees) between the first end 25 of the body 15 and the rear surface 100 of the light ring member 82 (FIG. 5). In the first intermediate position, the first angle is defined between the first and second illumination directions 40, 115. The light ring member 82 is also moveable to a second intermediate position defining a second angle (e.g., 90 degrees) between the first end 25 of the body 15 and the rear surface 100 of the light ring member 82 (FIG. 6). In the second intermediate position, the second angle is defined between the first and second illumination directions 40, 115. The light ring member 82 is further moveable to a third intermediate position defining a third angle (e.g., 135 degrees) between the first end 25 of the body 15 and the rear surface 100 of the light ring member 82 (FIG. 7). In the third intermediate position, the third angle is defined between the first and second illumination directions 40, 115. In some embodiments, the light ring member 82 may be temporarily fixed at one of the intermediate positions without being oriented in the second position (FIGS. 4 and 8).

The illustrated flashlight 10 is operable in a plurality of modes by displacing or depressing the actuator 75 to selectively provide electrical communication between the power source 60 and at least one of the first and second light sources 35, 110. In one embodiment, by depressing the actuator 75 in a first instance (e.g., a first mode of operation), the first and second light sources 35, 110 are powered by the power source 60 (e.g., the first and second light sources 35, 110 are ON). By depressing the actuator 75 in a second instance (e.g., a second mode of operation), the first light source 35 is ON and the second light source 110 is not powered by the power source 60 (e.g., is OFF). By depressing the actuator 75 in a third instance (e.g., a third mode of operation), the first light source 35 is OFF and the second light source 110 is ON. By depressing the actuator 75 in a fourth instance (e.g., a fourth mode of operation), both the first and second light sources 35, 110 are OFF. In other embodiments, the flashlight 10 may include more or less than four modes. For example, the flashlight 10 may include modes that vary the intensity (i.e., lumens) of light from the first light source 35 and/or the second light source 110.

With reference to FIG. 9, the illustrated flashlight 10 is selectively coupled to the conduit 80 by the resilient clip 70 and the light ring member 82 is positioned in the second position (FIGS. 4 and 8) such that the second illumination direction 115 extends within an inner portion 125 of the conduit 80. The central opening 105 of the light ring member 82 is configured to allow a tool 130 (e.g., screwdriver, magnetic pickup tool, tweezers, etc.) to be positioned through the central opening 105 and into the conduit 80 without blocking the light emitted by the second light source 110 (e.g., if the tool 130 was positioned between the conduit 80 and the second light source 110). In other words, the tool 130 extends through the central opening 105 and generally toward the second end 30 of the body 15. As such, objects within the conduit 80 are illuminated by the second light source 110 so that the object can be retrieved by the tool 130.

The invention claimed is:

1. A flashlight configured to be operable by a power source, the flashlight comprising:

a body including a first end and a second end, the body defining a central axis extending between the first end and the second end, the body configured to support the power source;

a first light source positioned adjacent the first end, the first light source electrically coupled to the power source and configured to produce light in a first illumination direction, the first illumination direction is fixed relative to the central axis of the body; and a light ring coupled to the first end of the body and movable with respect to the body about a pivot axis, the light ring including a second light source electrically coupled to the power source and configured to produce light in a second illumination direction;

wherein the second illumination direction moves relative to the first illumination direction in response to movement of the light ring relative to the body about the pivot axis;

wherein the light ring includes a central opening, and wherein light from the first light source is directed in the first illumination direction through the central opening.

2. The flashlight of claim 1, wherein the body includes a hinge post coupled to the first end, and wherein the light ring includes an arm coupled to the hinge post to enable the light ring to move about the pivot axis.

3. The flashlight of claim 1, wherein the light ring surrounds the light emitted from the first light source in the first illumination direction.

4. The flashlight of claim 1, wherein the light ring includes a rear surface that abuts the first end of the body when the first illumination direction is substantially parallel with the second illumination direction.

5. The flashlight of claim 1, wherein the light ring is movable to an open position in which the second illumination direction is opposite to the first illumination direction.

6. The flashlight of claim 5, wherein the light ring includes a central opening configured to receive a tool therethrough extending generally toward the second end of the body.

7. The flashlight of claim 6, further comprising an attachment member coupled to the body, wherein the attachment member is configured to engage a work piece to couple the flashlight to the work piece, and wherein the tool is configured to extend into the work piece through the central opening.

8. The flashlight of claim 7, wherein the flashlight is coupled to the work piece such that the second illumination direction extends into the work piece.

9. The flashlight of claim 1, wherein the second light source includes a plurality of discrete light sources.

10. A flashlight operable by a power source, the flashlight comprising:

a body including a first end and a second end, the body configured to support the power source;

a first light source positioned adjacent the first end, the first light source electrically coupled to the power source and fixed relative to the body;

a second light source coupled to the body, the second light source movable relative to the first light source about a hinge defining a pivot axis;

wherein the second light source is movable between a first position in which the first light source and the second light source emit light in substantially the same direction and a second position in which the first light source and the second light source emit light in substantially opposite directions.

11. The flashlight of claim 10, wherein the second light source is electrically coupled to the power source.

12. The flashlight of claim 10, wherein the first light source emits light in a first illumination direction, and wherein the first illumination direction is fixed relative to the body.

13. The flashlight of claim 12, wherein the second light source includes a plurality of discrete light sources arranged to emit light in a second illumination direction.

14. The flashlight of claim 13, further comprising a light ring configured to support the second light source as the second light source moves about the pivot axis.

15. The flashlight of claim 14, wherein the second illumination direction moves relative to the first illumination direction in response to movement of the light ring relative to the body about the pivot axis.

16. The flashlight of claim 15, wherein the light ring is movable to an open position in which the second illumination direction is opposite to the first illumination direction.

17. The flashlight of claim 16, wherein the light ring includes a central opening configured to receive a tool therethrough extending generally toward the second end of the body.

18. The flashlight of claim 17, further comprising an attachment member coupled to the body, wherein the attachment member is configured to engage a work piece to couple the flashlight to the work piece, and wherein the tool is configured to extend into the work piece through the central opening.

19. The flashlight of claim 18, wherein the flashlight is coupled to the work piece such that the second illumination direction extends into the work piece.

* * * * *